US006319080B1

(12) United States Patent
Watanabe et al.

(10) Patent No.: US 6,319,080 B1
(45) Date of Patent: Nov. 20, 2001

(54) OUTBOARD MOTOR COOLING AND ANODE SYSTEM

(75) Inventors: Kazuhiko Watanabe; Takuma Kameyama, both of Shizuoka (JP)

(73) Assignee: Sanshin Kogyo Kabushiki Kaisha (JP)

( * ) Notice: Subject to any disclaimer, the term of this patent is extended or adjusted under 35 U.S.C. 154(b) by 0 days.

(21) Appl. No.: 09/056,757

(22) Filed: Apr. 7, 1998

(30) Foreign Application Priority Data

Apr. 7, 1997 (JP) ..... 9-087993

(51) Int. Cl.[7] ..... B63H 21/10
(52) U.S. Cl. ..... 440/88; 204/147
(58) Field of Search ..... 440/88, 49, 113; 204/147, 148; 123/41.15, 41.14

(56) References Cited

U.S. PATENT DOCUMENTS

| | | | | |
|---|---|---|---|---|
| 2,565,068 | * | 8/1951 | Drabold | 123/3 |
| 2,857,892 | | 10/1958 | Hulsebus . | |
| 3,406,110 | | 10/1968 | Turnes et al. . | |
| 3,558,463 | | 1/1971 | Strobach et al. . | |
| 3,868,313 | | 2/1975 | Gay . | |
| 4,413,408 | * | 11/1983 | Riggs, Jr. | 29/825 |
| 4,486,181 | | 12/1984 | Cavil . | |
| 4,545,332 | * | 10/1985 | Suzuki et al. | 123/41.01 |
| 4,588,385 | * | 5/1986 | Suzuki et al. | 440/88 |
| 4,615,684 | * | 10/1986 | Kojima | 440/88 |
| 4,759,181 | * | 7/1988 | Biritz | 60/321 |
| 4,776,392 | * | 10/1988 | Loyd | 204/196.16 |
| 5,524,584 | | 6/1996 | Wantanabe . | |

* cited by examiner

*Primary Examiner*—S. Joseph Morano
*Assistant Examiner*—Andrew Wright
(74) *Attorney, Agent, or Firm*—Knobbe, Martens, Olson & Bear, LLP

(57) ABSTRACT

A mounting assembly for an anode of a corrosion protection system extends the useful life of the anode and hence the effectiveness of the system. The anode is mounted within an opening of an outboard motor engine. The engine also includes a coolant passage that extends through the engine and forms a portion of a cooling system. A biasing device biases the anode to contact the engine body. The anode also includes multiple contact surfaces which establish a plurality of electrical connections between the anode and the engine. In one mode, an electrically conductive cover links the anode to the engine at a point outside the opening. A seal is positioned between the opening and the cover to protect this electrical coupling. This outside connection thus ensures good electrical coupling between the anode and the engine body outside the presence of the coolant (e.g., salt water) flowing through the coolant passage.

44 Claims, 7 Drawing Sheets

OUTBOARD MOTOR COOLING AND ANODE SYSTEM

BACKGROUND OF THE INVENTION

1. Field of the Invention

The present invention relates in general to a marine engine, and more particularly to an anode system for a marine engine.

2. Description of Related Art

Outboard motors often power sea-faring boats. Large internal combustion engines of these motors drive propellers to propel the boat. Such engines produce a lot of heat and are housed within a poorly ventilated cowlings that protect the engines from the corrosive effects of salt water.

Outboard motors usually employ an open-loop cooling system to maintain the engine temperature below a particular degree. Such cooling systems commonly draw water into the outboard motor through a water inlet on a submerged lower unit, and circulate the water through the engine block, cylinder head, exhaust manifold and exhaust guide. Saline water, however, can cause the engine components to corrode, especially due to the dissimilarities of metals in the engine and the exhaust system, and the electrically conductive nature of salt water.

One means for reducing the corrosive effects associated with using salt water as a coolant is to provide a sacrificial anode within one or more of the cooling passages of the engine. Sacrificial anodes are typically employed to retard the corrosive effects of salt water on an engine block. The anti-corrosion effect is also useful in preventing galvanic corrosion resulting from differences in the materials (e.g., iron and aluminum) comprising the engine and the exhaust system.

Salt water within an anode-protected cooling system tends to corrode and dissolve the anode to the exclusion of the metal block and cylinder head. To facilitate this effect, the anode is typically formed from a material which more readily releases electrons than the metal forming the cylinder block and cylinder head (i.e., it has a lower oxidation potential). The anode, comprised of a "sacrificial metal," thus corrodes rather than the metal forming the engine. An outboard motor engine thus often includes several sacrificial anodes that are provided within the coolant passages in the cylinder block, adjacent to the engine cylinders.

SUMMARY OF THE INVENTION

The present anode system involves an improved mounting arrangement for an anode within a cooling passage of an internal combustion engine. In one mode, an enhanced electrical contact is maintained between the anode and an engine body in order to extend the useful life of the anode. An internal combustion engine comprises an engine body that includes at least one coolant passage and an opening which communicates with the coolant passage. The anode extends at least partially through the opening, and a conductive member is connected to the anode and to the engine body. The conductive member places the anode in electrical contact with the engine body outside of the opening. Corrosion within the opening therefore does not affect electrical communication between the anode and the engine body.

In accordance with another aspect of the present invention, an internal combustion engine for a marine drive comprises an engine body. The engine body includes at least one coolant passage and an opening that communicates with the coolant passage. An anode extends at least partially through the opening, and a sealing member is arranged to form a seal between the opening and an exterior of the engine body. The anode is mounted in the engine body such that at least a portion of the anode lies exposed on a side of the seal opposite the side on which the opening is located.

An additional aspect of the present invention involves an internal combustion engine comprising an engine body. The engine body includes at least one coolant passage and an opening that communicates with the coolant passage. An anode extends at least partially through the opening. A biasing device is arranged to act against and to bias the anode toward the opening. The anode includes a plurality of contact surfaces and is mounted on the engine body such that the plurality of contact surfaces are placed in electrical communication with the engine body at locations outside the opening.

Another aspect of the invention involves an improved biasing device for use with an engine anode. In one mode, the anode extends at least partially through an opening in an engine body, and a sealing member is arranged to form a seal between the opening and an exterior of the engine. A compression-type biasing device is positioned between at least a portion of the anode and at least a portion of the sealing member. The compression-type biasing device provides a force urging contact between the anode and the engine body, which greater than that provided by a grommet or similar seal.

Further objects, features, and advantages of the present invention over the prior art will become apparent from the detailed description of the drawings which follows, when considered with the attached figures.

BRIEF DESCRIPTION OF PRIOR ANODE SYSTEM

Before describing the preferred embodiments of the present anode system in detail, a brief description of a prior anode mounting arrangement and the problems associated with it is provided. This explanation is given in order,for the reader to appreciate further the present anode system and its associated advantages.

Figure 1:
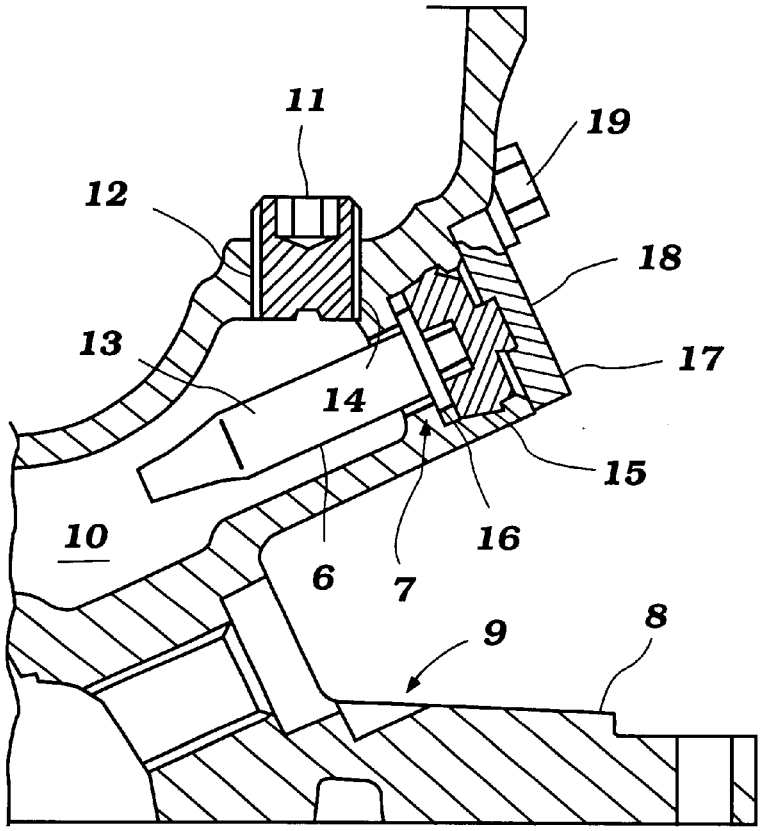
Figure 1 Prior Art
FIG. 1 is a partial cross-sectional view of an engine illustrating a prior sacrificial anode.

With reference now to FIG. 1, a prior sacrificial anode 6, which is similar to that disclosed in U.S. Pat. No. 5,524,584, is illustrated. The anode 6 is disposed within a mounting bore 7 of a cylinder head 8 above a spark plug well 9 and opens into a coolant passage 10. A plug 11 seals a casting sand drain 12 that lies near the mounting bore 7. The cooling water passes the coolant passage 10 and encounters an inner end 13 of the anode 6. The inner anode end 13 extends through an opening 14 in the wall of the cylinder head 8 that forms a portion of the mounting bore 7. A counterbore 15 circumscribes the opening 14 and receives a collar portion 16 of the anode 6. The anode 6 is prevented from sliding through the opening 14 by the collar portion 16. A grommet 17 is arranged between the collar portion 16 of the anode 6 and a cover portion 18. A fastener 19, such as a threaded bolt, secures the cover 18 to the engine.

The opening 14 is sized loosely receive the inner end 13 of the anode 6 with the collar 16 inserted into the counterbore 15. Due to the loose fit between the inner anode end 13 and the opening 14, water can flow around the anode 6 toward the counterbore 15. The interaction between the bottom of the counterbore 15 and the collar 16, however, provides a first seal. The grommet 17 forms a second seal on an outer side of the anode 6 (in reference to the coolant passage). The anode 6 also makes electrical contact with the cylinder head 8 through the contact between the anode collar 16 and the bottom of the counterbore 15.

Several problems can manifest with this type of anode mounting arrangement. The first seal often corrodes quickly because the metal of the anode collar 16 is comprised of the same sacrificial material as the anode inner end 13. The saline cooling water thus invades the space between the head of the anode 6 and the grommet 17 and corrodes this area. Not only does such corrosion complicate removal of the anode 6 when replacement is required (i.e., when the anode is spent), but it also degrades the electrical contact between the anode 6 and the cylinder head 8, and eventually impedes current flow between the anode 6 and the cylinder head 8 to a degree rendering the electrical contact useless. The reduction of the metal collar 16 also lessens the compression of the grommet 17 to impair the integrity of both the first and second seals.

DETAILED DESCRIPTION OF THE PREFERRED EMBODIMENTS OF THE PRESENT INVENTION

Figure 2:
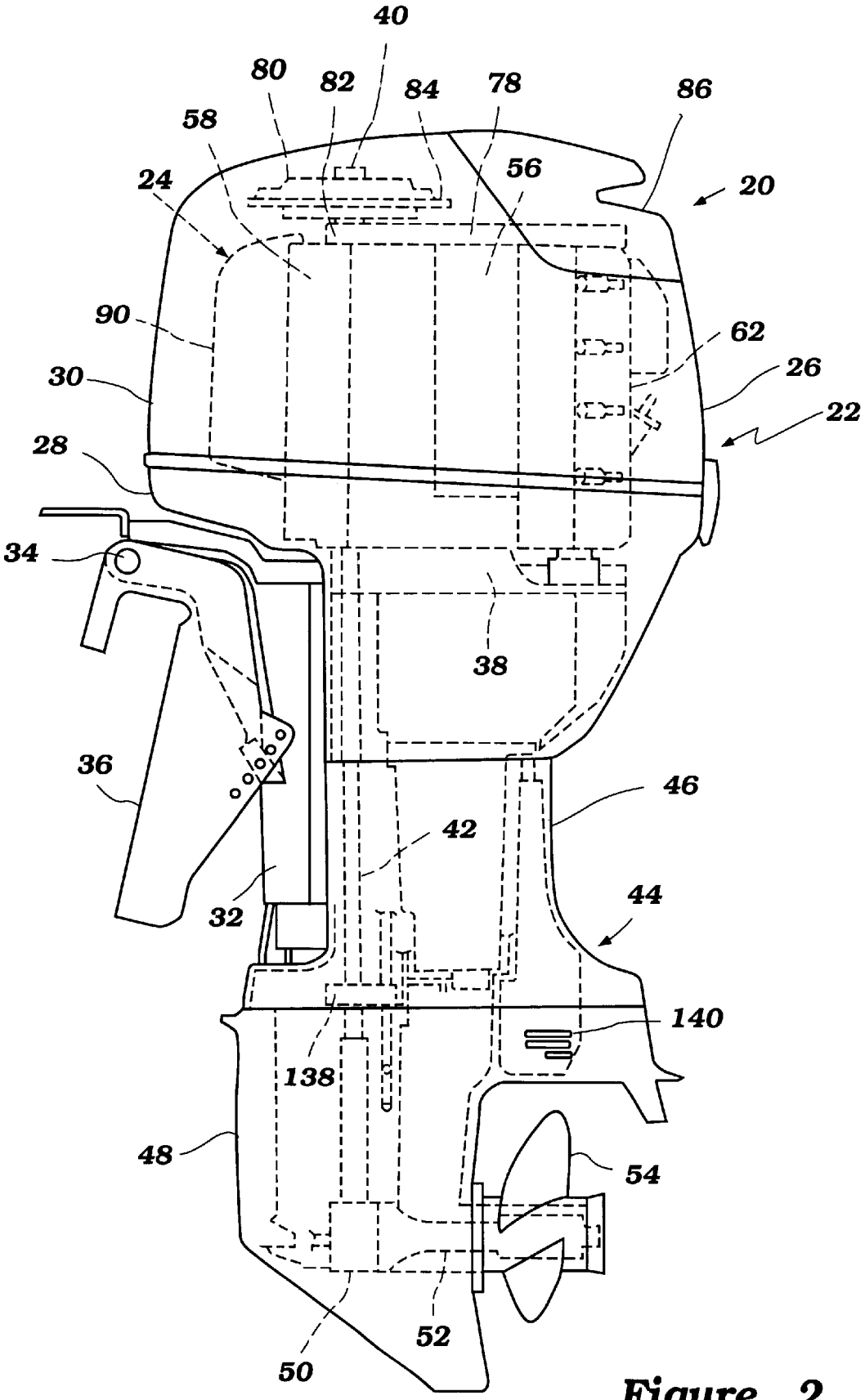
FIG. 2 is a side elevational view of an outboard motor having an engine arranged in accordance with the present invention, with the engine and other components internal to the motor illustrated in phantom.

With reference now initially to FIG. 2, an outboard motor constructed in accordance with an embodiment of the present invention is identified generally by the reference numeral 20. The outboard motor will be described to provide an exemplary environment for use of a sacrificial anode. As will be recognized by those of skill in the art, a variety of other applications may also benefit from the use of the present anode system.

The outboard motor 20 is utilized to power a watercraft (not shown). As best illustrated in FIG. 2, the outboard motor 20 has a powerhead assembly 22 comprised of an internal combustion engine 24 and a protective cowling 26. The cowling 26 in turn is comprised of a lower tray portion 28 and a main upper cowling portion 30 that is detachably connected to the tray 28 by means which may include a latch assembly (not shown).

A steering shaft, not shown, is supported for steering movement of the motor 20 about a vertically extending axis. The shaft is substantially encased by a swivel bracket 32. The swivel bracket 32 is connected by means of a pivot pin 34 to a clamping bracket 36. The clamping bracket 36 is attached to the watercraft. The pivot pin 34 permits the outboard motor 20 to be trimmed and tilted up about the horizontally disposed axis formed by the pivot pin 34.

The engine 24 is supported within the protective cowling 26 on a spacer plate or exhaust guide 38. The engine 24 has a crankshaft 40 which is rotatably journaled about a vertically extending axis. This orientation facilitates coupling the crankshaft 40 to a drive shaft 42.

A lower housing 44 has an upper section 46, or "drive shaft housing", and a lower unit 48 depending therefrom. The substantially vertical drive shaft 42 extends through both units 46, 48. The drive shaft 42 drives a conventional bevel gear in the lower unit 48, which is part of a forward/neutral/reverse transmission indicated generally by the reference numeral 50, and shown only schematically. The transmission 50 forms no part of the invention. Therefore, any known type of transmission may be employed.

The transmission 50 drives a propeller shaft 52 which is journaled within the lower unit 48 of the lower housing 44 in a known manner. A propeller, indicated generally by the reference numeral 54, is coupled at its hub to the propeller shaft 52. The rotation of the propeller 54 creates a propulsive force which moves the watercraft in a manner well known in this art.

The construction of the outboard motor 20 as thus far described may be considered to be conventional and, because it forms no part of the invention, further description of it is not believed to be necessary.

With reference now to FIGS. 2–6, the engine 24 will be described in more detail. The engine 24 is preferably of the in-line, four-cylinder variety operating on a four-cycle principal. It is to be understood, however, that the illustrated embodiments may also be utilized with engines having other configurations, other numbers of cylinders, and other operational principals.

The engine 24 includes a cylinder block 56 having four cylinder bores that have their axes disposed in a horizontal direction and which are vertically spaced one above the other. These cylinder bores support pistons (not shown) that reciprocate with the bores and that are connected by connecting rods (not shown) to drive the crankshaft 40.

As has been previously noted, the crankshaft 40 rotates about a vertically extending axis. This crankshaft 40 is journaled within a crankcase chamber 58 formed by the skirt of the cylinder block 56 and a crankcase member 60. The crankcase member 60 is affixed to one end of the cylinder block 56 in any known manner. It should be noted that the crankcase member 60 is formed at the front of the power head 22.

A cylinder head 62, is affixed to the opposite end of the cylinder block 56 and is formed with combustion chamber recesses 64, each of which cooperates with a respective one of the cylinder bores and a respective one of the pistons positioned within the corresponding cylinder bore. The recess 64, cylinder bore and piston together define one of the combustion chambers 66 of the engine.

In the illustrated embodiment, the engine 24 is of the overhead cam, two-valve per cylinder type. In order to operate an intake valve 68 and an exhaust valve (not shown), a cam shaft 70 is rotatably journaled within the cylinder head 62 in a known manner and engages rocker arms 72 for operating the valves associated with each cylinder in a well known manner. The valve mechanism as thus far described is contained within a valve chamber 74 that is closed by a cam cover 76 that is affixed to a cylinder block 56 in any well known manner.

Figure 3:
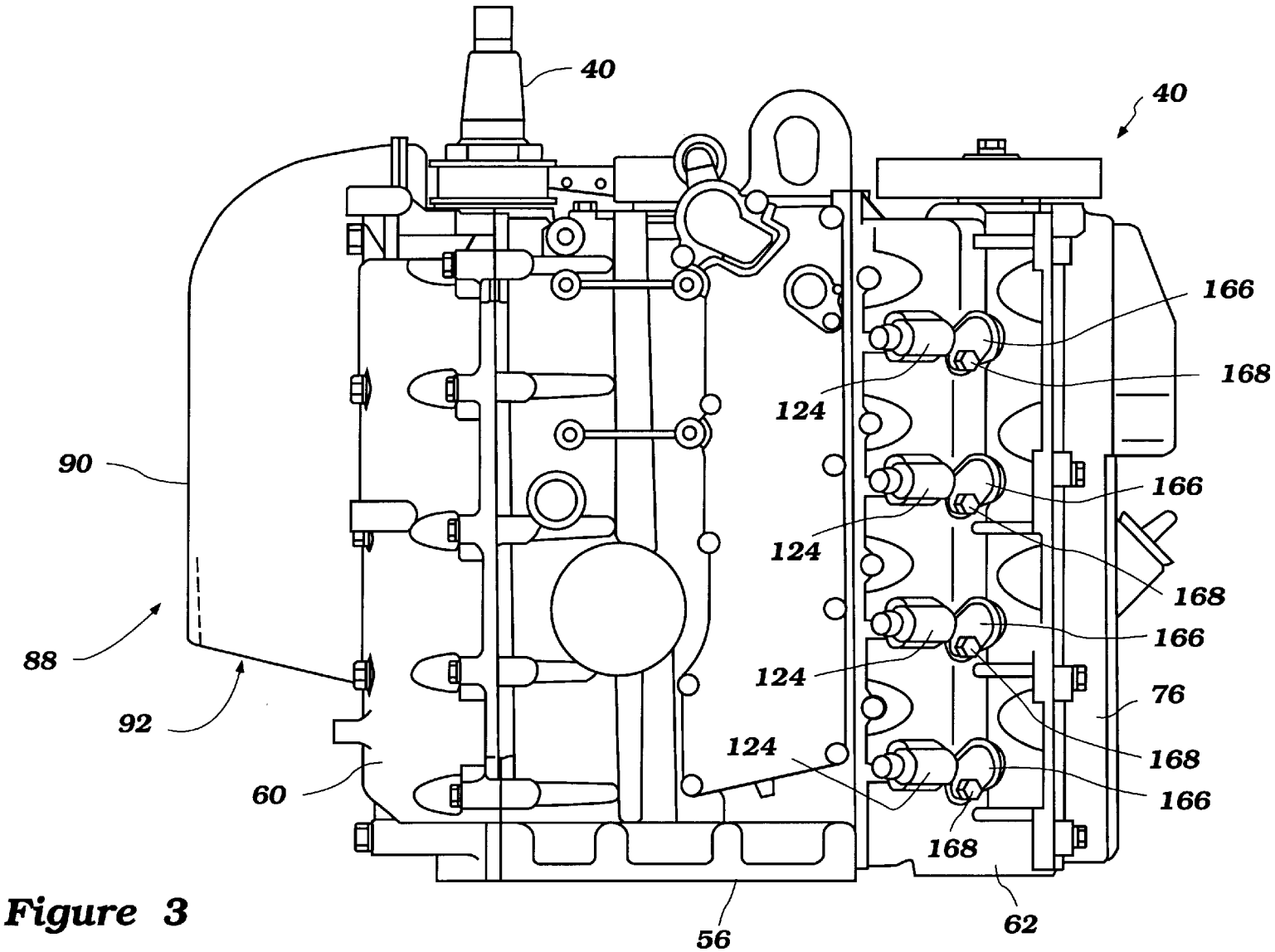
FIG. 3 is a side elevational view of the engine of FIG. 2, illustrating a cylinder head assembly.

The cam shaft 70 is driven from the crankshaft 40 at one-half crankshaft speed by a suitable cam driving arrangement and, as illustrated in FIGS. 2 and 3, this may constitute a timing belt drive, indicated generally at 78. In addition, a flywheel magneto assembly 80 is mounted on the crankshaft 40 above a sprocket 82 of the timing belt drive 78. This flywheel magneto assembly 80 also includes a starter gear 84 that is adapted to be engaged by an electric starter (not shown) for starting of the engine 24 electrically in a well known manner.

Atmospheric air is admitted to the interior of the protective cowling 26 by means of a rearwardly facing air inlet 86 formed in part of the main cowling member 30, as illustrated in FIG. 2. This atmospheric air is introduced to supply air for the combustion process of the engine 24 and is delivered to the cylinder head 62 by means of an induction system, indicated generally by the reference numeral 88 and which is shown in most detail at FIGS. 3 and 4.

This induction system 88 includes an air inlet device 90 that is mounted adjacent the crankcase member 60 and which extends in part forwardly of it in the power head 22. The air inlet device 90 has a downwardly facing air inlet opening 92 through which air is drawn. This air is then delivered to a plurality of intake pipes (not shown), which extend slightly in a downward direction from the air inlet device 90 to a plurality of charge formers such as carburetors (not shown).

Figure 4:
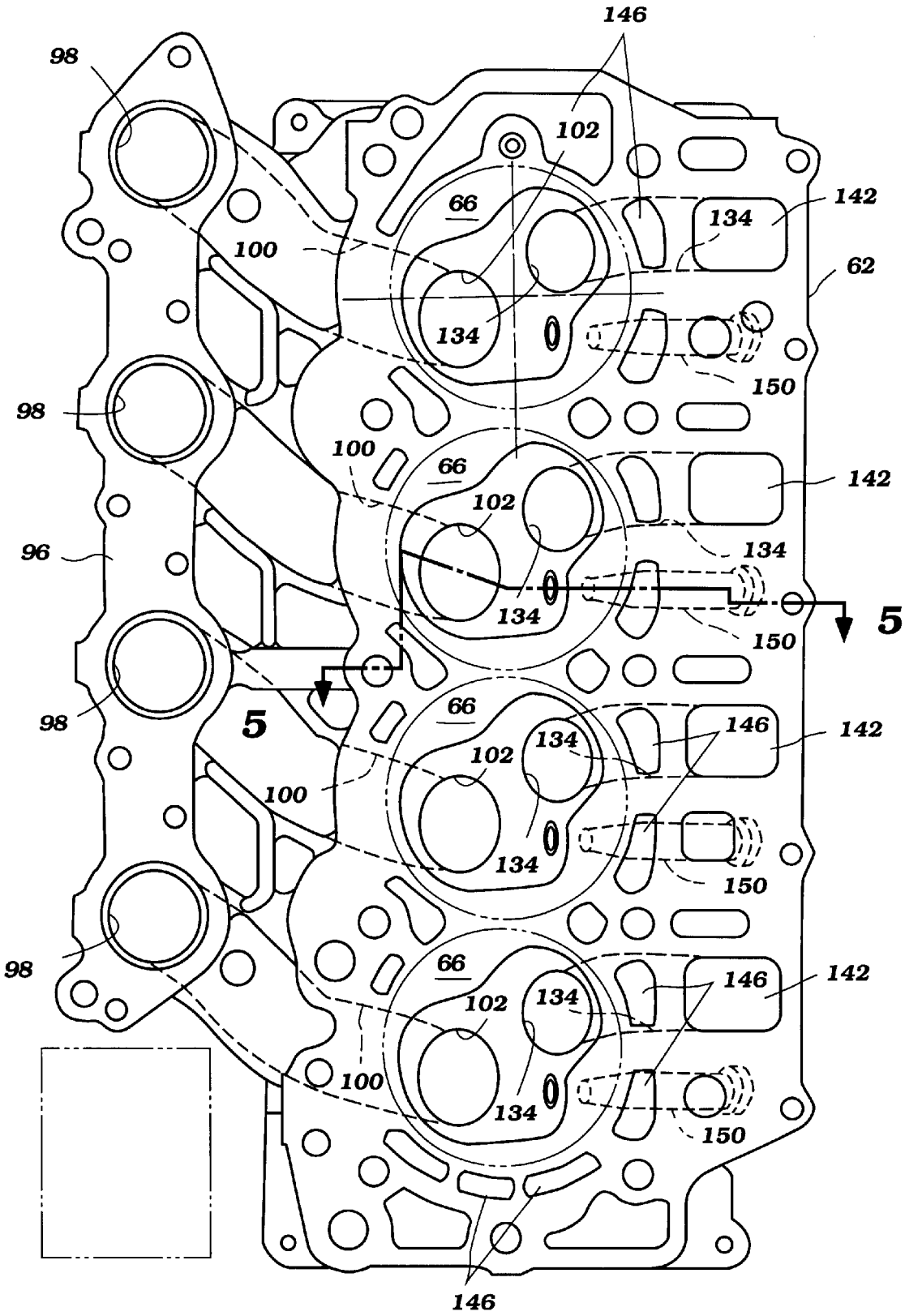
FIG. 4 is a bottom plan view the cylinder head of FIG. 3 shown as isolated from the engine with the anodes and other internal features illustrated in phantom.

The carburetors (not shown), in turn, supply the fuel-air mixture to the cylinder head 62 in a manner which will now be described by particular reference to FIGS. 4 and 5, although portions of the cylinder head induction system also appear in other figures. The cylinder head 62 has a lower surface 94 that is adapted to be maintained in sealing relationship with the cylinder block 56. Integral with the cylinder head 62 is a spaced apart flange portion 96 to which the carburetors are adapted to be affixed and which has a plurality of intake passage inlet openings 98 that face toward the cylinder block 56 but are spaced transversely outwardly from it.

The inlet openings 98 are formed at the inlet ends of the cylinder head intake passages 100, which are formed integrally in the cylinder head 62 and which extend in a generally U-shaped fashion from the downwardly facing inlet openings 98 to valve seats 102. The valve seats 102 are positioned in intake ports 104 formed in the combustion chamber recesses 64. As may be seen from FIG. 5, the valve seats 102 of the intake passages 100 are disposed substantially below the inlet openings 98. Hence, any fuel which may condense in the intake passages 100 will flow by gravity down to the valve seats 102 and into the combustion chamber recesses 64 each time the intake valves 68 are opened, as will now be described.

Each intake valve seat 102 is valved by means of a poppet-type intake valve 68, which has a head portion 106 that cooperates with the respective valve seat 102 for controlling the flow through the intake port 104. The head portions 106 are formed at one end of stem portions 108 that are supported for reciprocation within valve guides 110 pressed or cast into the cylinder head 62.

A retainer assembly 112 is affixed to the upper ends of the valve stem 108 and is engaged by a coil compression spring 114. The other end of the spring 114 engages a machined surface of the cylinder head 62 for urging the intake valves 68 to their closed position.

As has been previously noted, the intake valves 68 are operated by rocker arms 72 carried by a rocker shaft 116. These rocker arms 72 carry adjusting screws 118 at their outer ends which engage the tips of the valve stems 108. The rocker arms 72 are further provided with follower surfaces 120 that engage the lobes 122 of the camshaft 70 for opening the valves 68 in a well-known manner.

Figure 5:
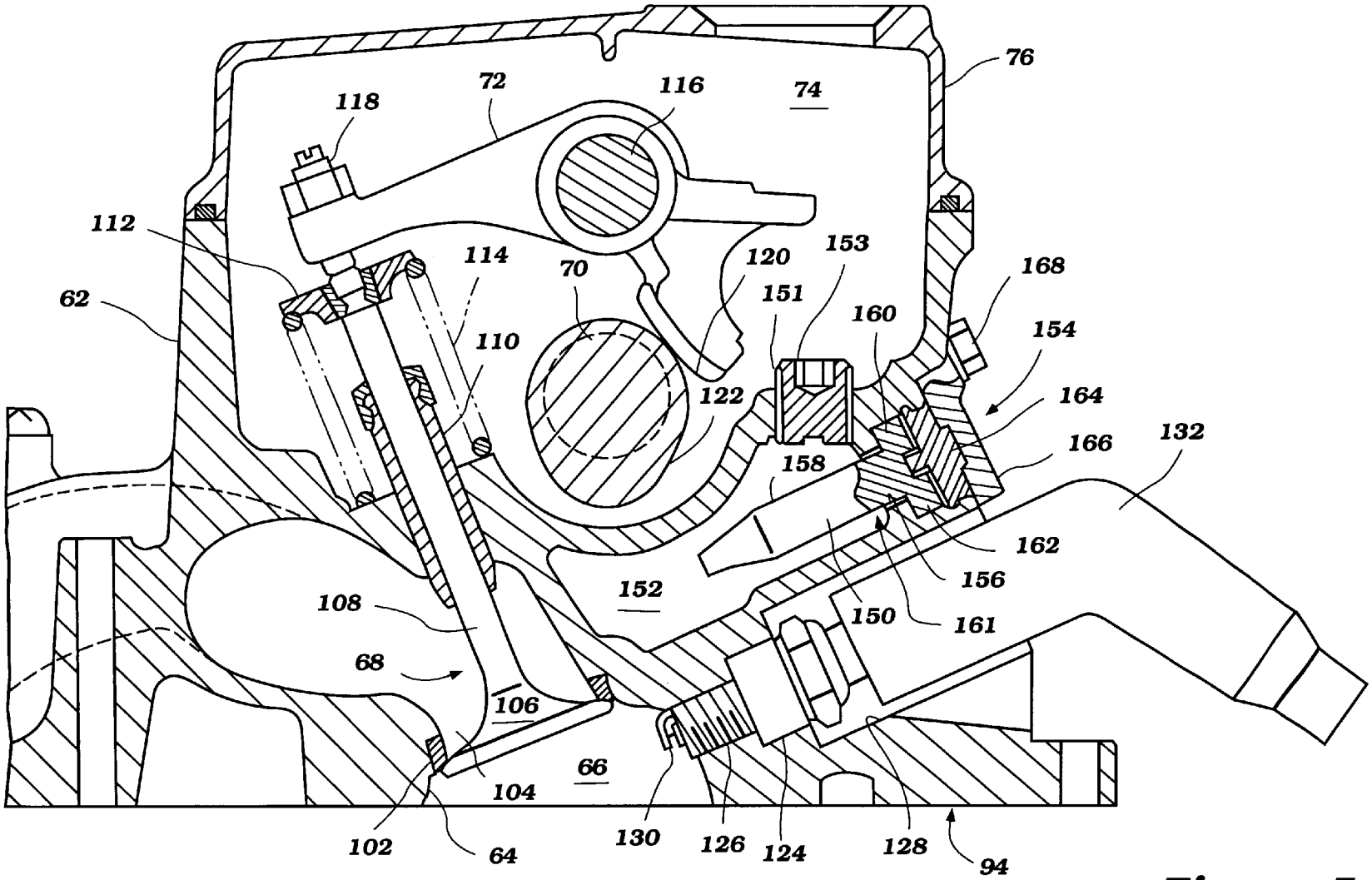
FIG. 5 is a partial sectional view of the engine illustrated in FIG. 2 taken along line 5—5 therein.

As may be seen in FIG. 5, the intake valve seats 102 and the heads 106 of the intake valves 68, when in their closed position, lie in the lower left-hand quadrant defined by a pair of intersecting planes containing the axes of the cylinder bores, which axes are shown by phantom lines in this figure. Thus, the intake valve seats 102 are formed relatively low in the combustion chambers 66, and this further permits the downward inclination of the intake passages 100 that avoid the problems of fuel puddling and uneven running at low speeds.

As illustrated in FIG. 5, the engine 24 has an ignition system. The ignition system includes a spark plug 124 having its tip positioned within the combustion chamber 66 and a head portion 126 extending into the cylinder head 62. The spark plugs 124 are mounted in spark plug recesses 128 on the exhaust side of the engine 24. An electrode 130 is provided in the head portion 126 of the spark plug 124 to provide proper ignition. The end of the spark plug 124 opposite the head portion 126 of the spark plug 124 extends into a plug cap 132.

An exhaust system is provided for routing exhaust from each combustion chamber 66 to a point outside of the outboard motor 20. The exhaust system includes an exhaust passage 134 leading through the cylinder head 62 from each combustion chamber 66. Flow of exhaust from the combustion chamber 66 to this passage 134 is controlled with a valve as is known to those skilled in the art. Exhaust which passes through the exhaust passages 134 flows to an exhaust manifold, not shown, and out of the motor 20 in a known manner.

The engine 40 also includes a coolant system 136. A coolant pump 138 maintains a flow of coolant through the cooling system 136. In the illustrated embodiment, the coolant pump 138 (see FIG. 1) is driven by the drive shaft 50. The coolant pump 138 pumps coolant (in this case, water from the body of water in which the outboard motor is positioned) from an inlet 140 through the lower unit 44 upwardly through a coolant inlet passage (not shown).

Figure 6:
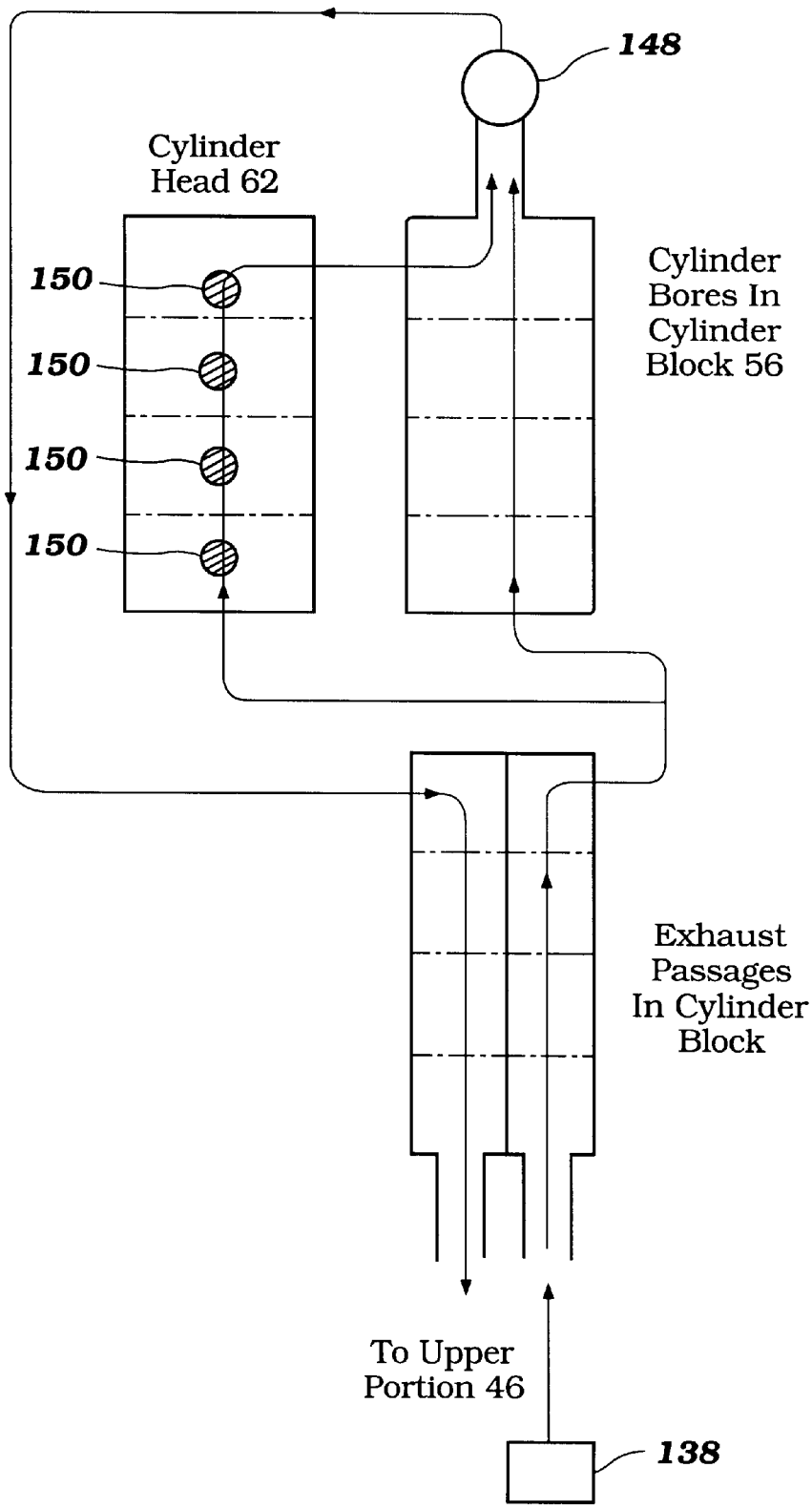
FIG. 6 is a schematic illustration of the coolant flow path through the engine illustrated in FIG. 2.

As best illustrated in FIG. 6, the engine coolant inlet passage (not shown) is connected to coolant jackets (not shown) which partially surround the exhaust passages (not shown) contained within the cylinder block 56. The coolant then flows into either coolant jackets which cool the combustion chambers 66 in the cylinder head 62 or coolant jackets which cool the cylinder bores contained within the cylinder block 56. The coolant is delivered to the cylinder head water jackets through a plurality of coolant inlet ports 142 which are provided at the bottom 94 of the cylinder head 62, as seen in FIG. 4.

The coolant inlet ports 142 of the cylinder head 62 are connected to coolant jackets which are internal to the cylinder head 62. The coolant jackets of the cylinder head 62 are defined by passages 152 which are desirably located proximate the combustion chamber 66 of the cylinder head 62. Preferably, the water jacket passages 152 are cast formed in the cylinder head 62 and cylinder block 56 during their formation. Clean-out openings or sand drains are cut into the passages to drain the sand following formation of the cylinder block 56 and cylinder head 62 and are plugged to form a sealed passage, as disclosed in more detail below.

A return passage 146 is provided for returning the coolant to through the cylinder block 56 adjacent to the exhaust passages through the cylinder block 56. The coolant passes through a thermostat 148 into the return passage from the coolant jackets of the cylinder bore regions. The return passage 146 extends to a coolant outlet formed in the lower section of the exhaust guide adjacent an expansion chamber (not shown) in the exhaust system.

The engine 24 is also provided with sacrificial anodes 150 designed to protect the internal cooling passages from corrosion. As shown in FIG. 5, and as introduced above, there are provided a plurality of passages 152 in the cylinder head 62 arranged substantially above each spark plug well 128. The sacrificial anodes 150 are inserted into the passages 152 and held in place by retainer assemblies 154. As introduced above, during fabrication of the cylinder head, the passages 152 are provided with drain holes 151 to remove the sand from the casting. The drain hole 151 is provided with a removable plug 153 to provide a watertight seal for the water jacket passages.

In the embodiment of FIGS. 2–6, the sacrificial anodes 150 are inserted into the water passages 152 through an opening 156 such that an inner end portion 158 of the anode 150 extends into the water passages 152. The inner portion 158 desirably lies on a side of the opening 156 which is opposite a seal as described below. Liquid coolant circulating through the engine cooling jacket passage encounters the end portion 158 of the sacrificial anodes 150 and corrosion desirably occurs on the replaceable anode 150 instead of the internal coolant passages 152.

Together, the opening 156 and a counterbore portion 160 define a mounting bore 161 for the anode 150. A collar portion or flange 162 of the anode 150 is received by the counterbore portion 160. Desirably, the collar portion 162 has a diameter substantially equal to the diameter of the counterbore. The relative diameters of the two members ensures that the side of the counterbore contacts the side of the collar of the anode while the collar is next to and abutting on the bottom surface of the counterbore 160. Thus, the anode 150 contacts the cylinder head 64 at multiple surfaces.

A grommet 164 sits on and abuts the collar portion 162 of the anode 150. The grommet 164 desirably fills a region defined within the counterbore between the anode's collar portion 162 and a cover plate 166. The grommet 164 is compressed to form a compressible seal. In the embodiment illustrated in FIG. 5, the cover plate 166 is secured over the anode 150 and the grommet 164 by a threaded fastener such as a bolt 168. The cover plate 166 may form a sealing member.

The arrangement of FIG. 5 improves the seal as well as the electrical contact between the anode 150 and the counterbore portion 162 by providing an extended contact surface as compared to prior mounting arrangements. The multiple contact surfaces also enhance the electrical contact between the cylinder head and the anodes. The improved seal helps to prevent the infusion of corrosive cooling water into the anode head mounting chamber defined by the counterbore 160 and the cover plate 166. In addition, the anode has an outer end portion on the side of the seal opposite the opening. This outer end is not in contact with the coolant in the passage 152.

Two other embodiments having features and advantages in accordance with the present invention will now be described with reference to FIGS. 7, 8 and 9 respectively. In these descriptions, features common to the first embodiment will retain the same reference numerals.

Figure 8:
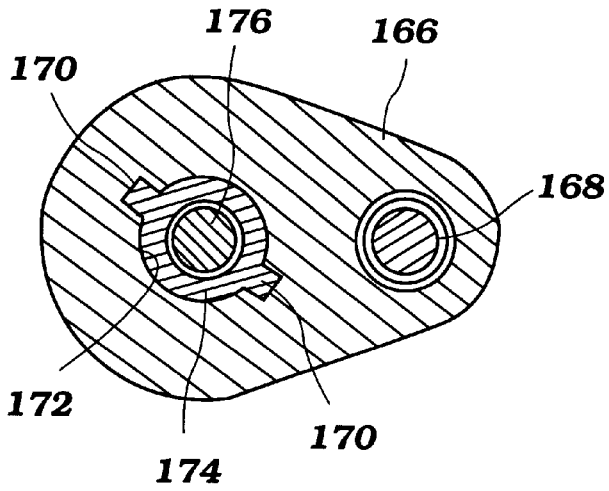
FIG. 8 is a cross-sectional view of a conductive cover and anode assembly illustrated in FIG. 7 taken along line 8—8 therein.
Figure 7:
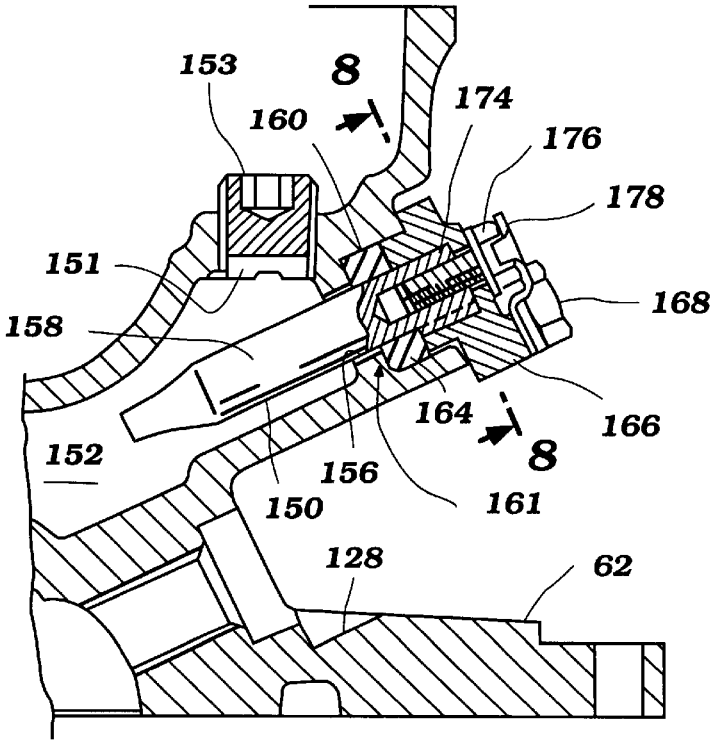
FIG. 7 is a partial cross-sectional view of an engine, similar to that illustrated in FIG. 5, and illustrates another embodiment of an anode mounting arrangement.

FIGS. 7 and 8 illustrate another embodiment of a sacrificial anode 150. As illustrated in FIG. 7, the sacrificial anode 150 has an inner end portion 158 which extends into a coolant passage 152 of the cylinder head 62. As in the previous embodiment, coolant passes over the end portion 158 of the sacrificial anode 150.

In the embodiment of FIGS. 7 and 8, the anode 150 extends through an opening 156 leading to the coolant passage 152. The anode 150 has an elongated shape as illustrated. The anode 150 extends through a grommet 164 and into a conductive cover plate 166 arranged outside of the opening 156. As illustrated in FIG. 8, the head portion of the anode is provided with a flange structure 170 which is keyed to a hole 172 in the conductive cover plate 166. A head portion 174 of the anode is also provided with an internally threaded bore such that a threaded fastener 176, a bolt for example, can fasten the anode 150 to the cover plate 166. The interface between the cover and the anode thus occurs at multiple surfaces. Accordingly, the anode is advantageously designed to contact the cylinder head along multiple surfaces.

The cover plate 166 is secured to the cylinder head 62 by the threaded fastener 168. In the illustrated embodiment, a portion of the cover plate 166 extends into the counterbore. The anode 150 can be provided with an biasing device 176. In the embodiment of FIGS. 7 and 8, the biasing device is preferably a leaf spring, although other forms of biasing devices may also be utilized. Accordingly, the biasing device 178 urges the anode downward toward the passage 152. The biasing device 178 assures quality contact with an engine component even after corrosion of the anode 150 has begun. This structure further provides additional contact surfaces between the engine and the anode. Accordingly, the useful life of a sacrificial anode may be extended by this embodiment.

Figure 9:
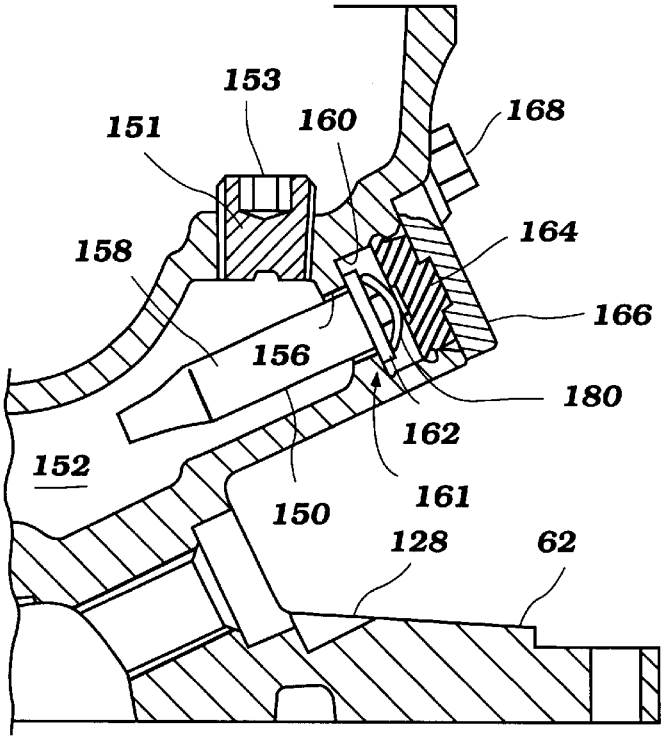
FIG. 9 is a partial cross-sectional view of an engine, similar to that illustrated in FIG. 5, and illustrates an additional embodiment of an anode mounting arrangement.

FIG. 9 illustrates another embodiment. The anode 150 is mounting in a similar manner to the embodiments described above. The anode 150, in this embodiment, is provided with an alternative biasing device 180 to urge the collar 162 of the anode 150 into contact with the lower surface of the counterbore 160. In other words, the biasing device 180 urges the anode 150 toward the coolant passage 152. In particular, the biasing device 180 is a Belleville spring; however, other compression-type biasing devices may also be used. For example, a compression-type coil spring may also form at least part of the biasing device. The Belleville spring urges the collar portion 162 downward due to a force applied to the top of the spring by the grommet 164 and the cover plate 166. The cover plate 166 is held in place by the threaded fastener 168 as in the previous embodiments.

The Belleville spring device urges the collar portion 162 of the anode 150 into contact with the lower surface of the counterbore 160. Accordingly, when corrosion begins, contact surface area and sealing force is not diminished by loss of material. The biasing device 180, therefore, helps to increase the useful life of the sacrificial anode and maintain the pressure seal over the opening 156 to the coolant passage 152.

Of course, the foregoing description is that of preferred embodiments of the invention, and various changes and modifications may be made without departing from the spirit and scope of the invention, as defined by the appended claims.

What is claimed is:

1. An internal combustion engine for a marine drive comprising an engine body including at least one coolant passage and an opening communicating with the coolant passage, an anode extending at least partially through the opening, the anode comprising a head portion and a conductive cover being electrically connected to an outer end of the anode and to the engine body at a location outside the opening, whereby the conductive cover places the anode in electrical communication with the engine body and covers the opening and at least a portion of the anode.

2. An engine as in claim 1, wherein the cover and the anode include a keyed connection.

3. An engine as in claim 1 additionally comprising a biasing device arranged to bias the anode toward the coolant passage.

4. An engine as in claim 3, wherein the biasing device comprises a leaf spring.

5. An engine as in claim 1 additionally comprising a sealing member positioned between the opening and the conductive member.

6. An engine as in claim 5, wherein the sealing member is positioned around the anode.

7. An engine as in claim 1, wherein the anode has an elongated shape.

8. An engine as in claim 1, wherein the engine body includes a cylinder head, the opening is formed in the cylinder head, and the conductive member is connected to the cylinder head next to the opening.

9. An engine as in claim 8, wherein the cylinder head includes a counterbore that circumscribes the opening, and the conductive member lies at least partially over counterbore.

10. An engine as in claim 1, wherein the opening comprises a counterbore portion, the head portion of the anode being positioned at least partially within the counterbore portion.

11. An engine for a marine drive comprising an engine body including at least one coolant passage and an opening communicating with the coolant passage, an anode extending at least partially through the opening, a conductive cover being mounted to the engine body and being attached to an outer portion of the anode, the conductive cover electrically connecting the outer portion of the anode and the engine body, and a sealing member arranged to form a seal between the opening and an exterior of the engine, the anode being mounted in the engine body such that at least an outer portion of the anode lies on a side of the seal opposite the side on which the opening is located.

12. An internal combustion engine comprising an engine body including at least one coolant passage and an opening communicating with the coolant passage, an anode extending at least partially through the opening, the anode including a head portion and a base portion, a conductive biasing device being arranged to act against and to bias the anode toward the cooling passage, the anode having a plurality of contact surfaces and being mounted on the engine body such that the plurality of contact surfaces are placed in electrical communication with the engine body at locations outside the opening.

13. An engine as in claim 12 additionally comprising a conductive cover connected to the anode outside the opening and affixed to the engine body in a manner placing the anode in electrical communication with the engine body, the conductive cover covering the opening and at least a portion of the anode.

14. An engine as in claim 13, wherein the anode includes a protrusion and the conductive cover includes a correspondingly shape receptacle.

15. An engine as in claim 12, wherein the engine body includes a counterbore, and the outer diameter of the head portion is larger than the base portion and the head portion is sized to match the diameter of the counterbore such that the anode makes electrical contact with the engine body at a bottom of the counterbore and along a sidewall of the counterbore.

16. An engine as in claim 12, wherein the biasing device comprises a compressible seal.

17. An engine as in claim 12, wherein the biasing device comprises a compression-type spring.

18. An engine as in claim 12, wherein the biasing device comprises a leaf spring.

19. An engine as in claim 12, wherein the biasing device is a threaded fastener that extends into the head portion of the anode.

20. An internal combustion engine for a marine drive comprising an engine body including at least one coolant passage and an opening communicating with the coolant passage, an anode extending at least partially through the opening, a conductive member that is not a portion of the anode being electrically connected to the anode and to the engine body at a location outside the opening, whereby the conductive member is a cover that, at least in part, places the anode in electrical communication with the engine body, the cover being connected to an outer end of the anode and overlying the opening and at least a portion of the anode.

21. An engine as in claim 20, wherein the cover and the anode include a cooperating keyed connection.

22. An engine as in claim 20 additionally comprising an electrically conductive biasing device arranged to bias the anode toward the coolant passage.

23. An engine as in claim 22, wherein the biasing device is a threaded member that extends into an end of the anode.

24. An engine as in claim 20 additionally comprising a sealing member positioned between the opening and the conductive member.

25. An engine as in claim 24, wherein the sealing member is positioned around the anode.

26. An engine as in claim 20, wherein the engine body includes a cylinder head, the opening is formed in the cylinder head, and the conductive member is connected to the cylinder head next to the opening.

27. An engine as in claim 26, wherein the cylinder head includes a counterbore that circumscribes the opening, and the conductive member lies at least partially over counterbore.

28. An engine for a marine drive comprising an engine body including at least one coolant passage and an opening communicating with the coolant passage, the opening comprising a counterbore portion that extends to an outer surface of the engine body, an anode extending at least partially through the opening, a conductive cover being mounted to the engine body and being attached to the anode, the conductive cover electrically connecting the anode to the engine body, and a sealing member arranged to form a seal between the opening and an exterior of the engine, the seal being positioned within the counterbore portion, the anode being mounted at least partially in the opening such that at least an outer portion of the anode lies on a side of the sealing member opposite the side on which the opening is located.

29. An engine as in claim 28, wherein the separate conductive member electrically connects the outer portion of the anode to the outer surface of the engine body.

30. An internal combustion engine for a marine drive comprising an engine body including at least one coolant passage and an opening communicating with the coolant passage, an anode extending at least partially through the opening, a conductive biasing device arranged to bias the anode toward the coolant passage, the anode comprising a head portion and a conductive member being electrically connected to the head portion of the anode and to the engine body at a location outside the opening, the conductive member placing the anode in electrical communication with the engine body.

31. An engine as in claim 30, wherein the biasing device comprises a leaf spring.

32. An engine as in claim 30, wherein the biasing device comprises a threaded member.

33. An engine as in claim 30, wherein the biasing device comprises a Bellville spring.

34. An engine as in claim 30 additionally comprising a sealing member positioned between the opening and the conductive member.

35. An engine as in claim 34, wherein the sealing member is positioned around the anode.

36. An engine as in claim 30, wherein the anode has an elongated shape.

37. An engine as in claim 30, wherein the engine body includes a cylinder head, the opening is formed in the cylinder head and the conductive member is connected to the cylinder head next to the opening.

38. An engine as in claim 37, wherein the cylinder head includes a counterbore that circumscribes the opening and the conductive member lies at least partially over the counterbore.

39. An internal combustion engine comprising an engine body including at least one coolant passage and an opening communicating with the coolant passage, an anode extending at least partially through the opening, the anode including a head portion and a base portion, a biasing device being arranged to act against and to bias the anode toward the cooling passage, the anode having a plurality of contact surfaces and being mounted on the engine body such that the plurality of contact surfaces are placed in electrical communication with the engine body at locations outside the opening, a conductive cover being connected to the anode outside the opening and being affixed to the engine body in a manner placing the anode in electrical communication with the engine body, the conductive cover covering the opening and at least a portion of the anode.

40. An engine as in claim 39, wherein the anode includes a protrusion and the conductive cover includes a correspondingly shape receptacle.

41. An engine as in claim 39, wherein the engine body includes a recess, and the outer perimeter of the head portion is larger than the base portion and the head portion is sized to match the outer perimeter of the recess such that the anode makes electrical contact with the engine body at a bottom of the recess and along a sidewall of the recess.

42. An engine as in claim 39, wherein the biasing device comprises a compressible seal.

43. An engine as in claim 39, wherein the biasing device comprises a compression-type spring.

44. An engine as in claim 39, wherein the biasing device comprises a leaf spring.

* * * * *